US008888399B2

(12) United States Patent
Redlberger

(10) Patent No.: US 8,888,399 B2
(45) Date of Patent: Nov. 18, 2014

(54) ROADSIDE TRAFFIC BARRIER

(75) Inventor: Alfred Redlberger, Scheib (AT)

(73) Assignee: Rebloc GmbH, Gars/Kamp (AT)

( * ) Notice: Subject to any disclaimer, the term of this patent is extended or adjusted under 35 U.S.C. 154(b) by 0 days.

(21) Appl. No.: 13/643,145

(22) PCT Filed: May 5, 2011

(86) PCT No.: PCT/EP2011/057216

§ 371 (c)(1),
(2), (4) Date: Dec. 3, 2012

(87) PCT Pub. No.: WO2011/138401

PCT Pub. Date: Nov. 10, 2011

(65) Prior Publication Data

US 2013/0094903 A1 Apr. 18, 2013

(30) Foreign Application Priority Data

May 6, 2010 (AT) ..... A 768/2010

(51) Int. Cl.

| | |
|---|---|
| ***E01F 13/00*** | (2006.01) |
| ***E01F 15/00*** | (2006.01) |
| ***E01F 15/08*** | (2006.01) |
| ***E01F 8/00*** | (2006.01) |
| ***E04H 12/10*** | (2006.01) |

(52) U.S. Cl.

CPC ..... *E01F 13/00* (2013.01); *E01F 15/08* (2013.01); *E01F 8/0005* (2013.01); *E04H 12/10* (2013.01)

USPC ..... 404/6; 256/13.1

(58) Field of Classification Search

USPC ..... 404/6, 10; 256/13.1; 52/144, 405.1, 52/405.2; 40/612

See application file for complete search history.

(56) References Cited

U.S. PATENT DOCUMENTS

| | | | | | |
|---|---|---|---|---|---|
| 3,114,303 | A | * | 12/1963 | Oberbach | 256/13.1 |
| 4,175,639 | A | * | 11/1979 | Wirt | 181/210 |
| 5,015,119 | A | * | 5/1991 | Schmanski | 404/12 |
| 5,186,438 | A | * | 2/1993 | Cross et al. | 256/13.1 |
| 5,539,163 | A | * | 7/1996 | Anderson et al. | 181/210 |
| 6,840,706 | B1 | * | 1/2005 | Camomilla et al. | 404/6 |
| D505,456 | S | * | 5/2005 | Green | D20/40 |
| 7,104,720 | B2 | * | 9/2006 | Humphries et al. | 404/6 |
| 7,220,077 | B2 | | 5/2007 | Humphries | |

(Continued)

FOREIGN PATENT DOCUMENTS

| | | | |
|---|---|---|---|
| AT | 502935 | A | 6/2007 |
| DE | 9000972 | U | 9/1990 |

(Continued)

*Primary Examiner* — Abigail A Risic

(74) *Attorney, Agent, or Firm* — Andrew Wilford

(57) ABSTRACT

The invention relates to a restraint system for vehicles in the region of roads, which is combined with substantially panel-shaped screening and/or noise protection elements (1), wherein deflecting elements (2), which are made of concrete for example, are connected to supports (4) via connecting webs (3), and the screening and/or noise protection elements (1) are held between the lateral surfaces which extend in the longitudinal direction of the deflecting elements (2) and which face the screening and/or noise protection elements (1) and the lateral surfaces of the supports (4) which face the screening and/or noise protection elements (1). The screening and/or noise protection elements (1) are provided at their lower edge with open slots (6, 6') in which the connecting webs (3, 3') of the deflecting elements (2) engage.

8 Claims, 5 Drawing Sheets

(56) References Cited

U.S. PATENT DOCUMENTS

| | | | | |
|---|---|---|---|---|
| 7,546,900 | B2 * | 6/2009 | Humphries et al. | 181/286 |
| 7,568,553 | B2 * | 8/2009 | Wiebel et al. | 181/289 |
| 7,793,910 | B2 * | 9/2010 | Salman | 248/519 |
| 8,001,880 | B2 | 8/2011 | White | |
| 8,561,371 | B2 * | 10/2013 | Sanders et al. | 52/764 |
| 2005/0104054 | A1 * | 5/2005 | Humphries et al. | 256/13.1 |
| 2005/0265780 | A1 * | 12/2005 | Humphries et al. | 404/6 |
| 2008/0271652 | A1 * | 11/2008 | White et al. | 109/49.5 |
| 2009/0154998 | A1 | 6/2009 | O'Neal | |

FOREIGN PATENT DOCUMENTS

| | | | |
|---|---|---|---|
| DE | 9301089 | U | 5/1993 |
| EP | 1910622 | A | 4/2008 |
| WO | 9424372 | A | 10/1994 |
| WO | 0039404 | A | 7/2000 |

* cited by examiner

ROADSIDE TRAFFIC BARRIER

CROSS REFERENCE TO RELATED APPLICATIONS

This application is the US-national stage of PCT application PCT/EP/2011/057216 filed 5 May 2011 and claiming the priority of Austrian patent application 768/2010 itself filed 6 May 2010.

FIELD OF THE INVENTION

The invention relates to a traffic barrier, for example, deflectors of concrete and essentially screening and/or noise-protection panels that rest with side faces extending longitudinally of the deflectors against the screening and/or noise-protection elements.

PRIOR ART

The screening and/or noise-protection elements in a known traffic barrier of this type (see EP 1910622) are provided with a one-piece integrated pedestal that extends from both sides of the protective elements and on which deflectors are mounted at least on one side.

This known solution results in the disadvantage that producing the protective elements entails high costs, in particular, due to the requisite forms needed to produce the elements composed of hardening plastic material, for example concrete. In addition, this system requires connecting the protective elements and deflectors with incorporated fasteners in order to be able to construct a system of this type over an extended distance.

In addition, AT 502935 discloses a system in which the screening and/or noise-protection elements are attached to the top of the deflectors.

This solution entails the problem that large bending loads are produced on the deflectors due to the force of wind in the region of the joint of the protective elements, and on-site installation requires high labor costs. This system also requires that the deflectors and the protective elements be interconnected with high tensile strength so as to prevent an individual element from shearing off the combined assembly of elements in the event of an impact by a vehicle.

A traffic barrier of the type referenced above has been disclosed in U.S. Pat. No. 7,220,077. Here noise-protection elements are screwed onto the flat sides of the deflectors. The disadvantage here is that the deflectors must be anchored very securely in the ground since the whole structure could otherwise topple over in response to a violent impact (for example by a truck).

OBJECT OF THE INVENTION

The object of this invention is to avoid this disadvantage and to propose a traffic barrier of the type described above, the individual components of which can be easily produced and which can be easily installed to create a continuously connected wall such that the risk of toppling over is significantly reduced.

SUMMARY OF THE INVENTION

This is achieved with a traffic barrier of the type described above in which

- the screening and/or noise-protection elements rest with longitudinally extending side faces extending on the deflectors,
- the deflectors are attached either directly or through the screening and/or noise-protection elements to braces provided on opposite side faces of the screening and/or noise-protection elements, and
- the screening and/or noise-protection elements are retained between sides faces the deflectors and confronting side faces of the braces.

The proposed measures enable the screening and/or noise-protection elements, hereafter identified as protective elements, to be retained by the deflectors and their braces. The tilt axis is thus located at the back of the brace, with the result that in the event of an accident not only—as in U.S. Pat. No. 7,220,077—the deflector but also the entire protective wall (and to a lesser extent the brace as well) would have to be lifted. As a result, the weight of the protective wall is exploited to enhance the stability against toppling over.

Nevertheless, the protective elements and the deflectors can be produced from a hardenable material such as concrete, using simple molds or forms.

Attaching the deflectors to the braces by connectors and providing the screening and/or noise-protection elements with slots open at their bottom edges and fitted over the connectors of the deflectors provide two advantages: First these involve a connection between deflectors and braces that is very simple to implement; second, any displacement of the protective wall longitudinally is prevented.

It is especially advantageous when the screening and/or noise-protection elements rest on the connectors by floors of their slots that have a depth equal to less than the height of the connectors from the ground with the result that a gap remains between the ground and the screening and/or noise-protection elements. This produces a statically determinate support for the protective elements that is constant (not simply in the event of an accident), while the weight of these elements increases the resistance to displacement of the deflectors in response to an impact by a vehicle.

It is advantageous to provide elastic shims between the side faces of the screening and/or noise-protection elements and the confronting faces of the deflectors and their braces so as to prevent sudden stresses on the deflectors by the protective elements where they are held, for example due to wind, and thus any deflection of the corresponding faces. This approach ensures there is an essentially progressive rise in the load on the deflectors or their brace in response to wind forces and enables tolerances to be balanced.

It is advantageous when the screening and/or noise-protection elements taper downward in a lower region engaging the deflectors and the confronting faces of the deflectors and the braces are complementary with one side face of the screening and/or noise-protection elements being continuously flat so as to enable simple installation of the protective elements. The taper in the thickness of the protective elements thus facilitates insertion of the protective elements between confronting faces of the deflectors and their braces.

This simplifies the requisite forms along with a consistently even implementation of one side of the protective elements, thereby lowering production cost for the elements.

The deflectors and the braces are connected through spacers by fasteners to the screening and/or noise-protection elements, in which case both the screening and/or noise-protection elements as well as the deflectors and braces are formed at the spacers with holes for the fasteners to connect the screening and/or noise-protection elements to the deflectors and the braces in an alternative embodiment of the invention for achieving a solution to the problem. It is advantageous when the spacers are integrally molded as one piece into the deflectors, the braces, or the screening and/or noise-protection elements so as to require the fewest possible individual components needed to install the traffic barrier.

In another alternative embodiment, provision can be made whereby the deflectors are connected directly (that is, not through the protective wall) by fasteners to the braces that pass through the protective wall.

Providing the braces provided in essentially mirror-symmetrical fashion relative to the deflectors gives the advantage whereby the traffic barrier according to the invention can easily also be employed as a roadway divider. Producing these deflectors can be easily implemented in essentially trough-shaped molds into which the corresponding cores can be inserted, where gaps are left free between the individual cores to as to create connectors.

The traffic barrier according to the invention where according to the invention multiple deflectors or braces and multiple screening and/or noise-protection elements are connected in succession with joints between the individual deflectors or braces on the one side and joints between the individual screening and/or noise-protection elements on the other side being offset relative to each other allows for the elimination of a high-tensile-strength connection between individual elements in the longitudinal axis to secure the system against breakdown in the event of an impact, and this yields a significant reduction in cost. The offset here of joints between the deflectors on the one hand and the protective elements on the other hand enables a very strong bonded assembly to be achieved between the elements, with the result that individual elements can be pushed out of the assemblage of the elements only after complete destruction of either the protective element or a deflector.

It is advantageous to attach impact elements by spacers to the side of the deflectors facing the roadway, in particular, in order to enable a high level of impact energy to be absorbed and to ensure reduced stress on the occupants during an impact by a light vehicle.

BRIEF DESCRIPTION OF THE DRAWING

The following describes the invention in more detail based on the drawing. Therein.

SPECIFIC DESCRIPTION OF THE INVENTION

Figure 1:
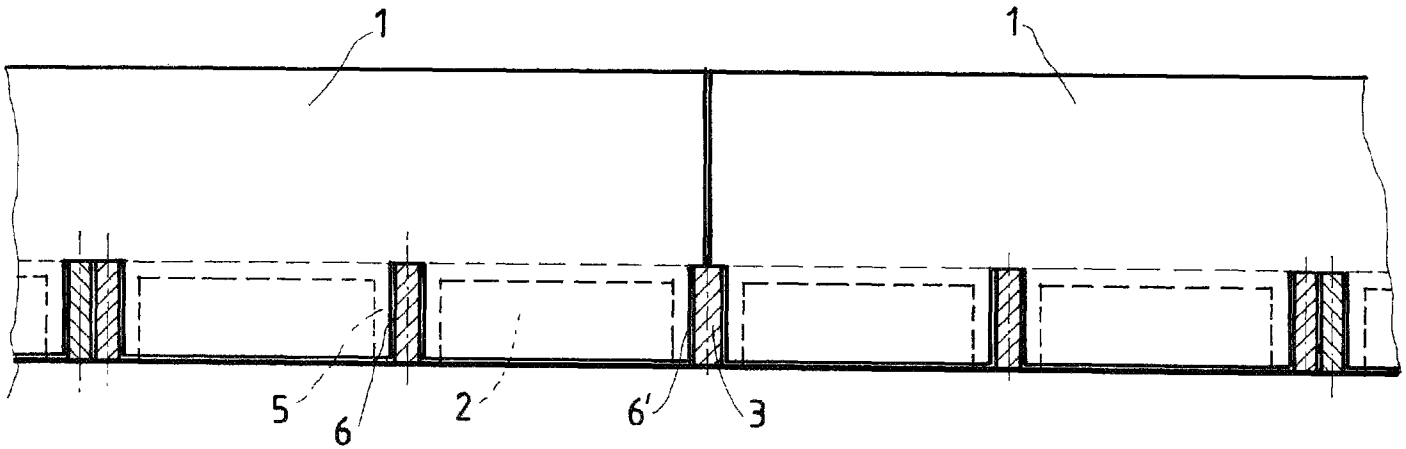
FIG. 1 is a schematic sectional rear view of a traffic barrier according to the invention.
Figure 2:
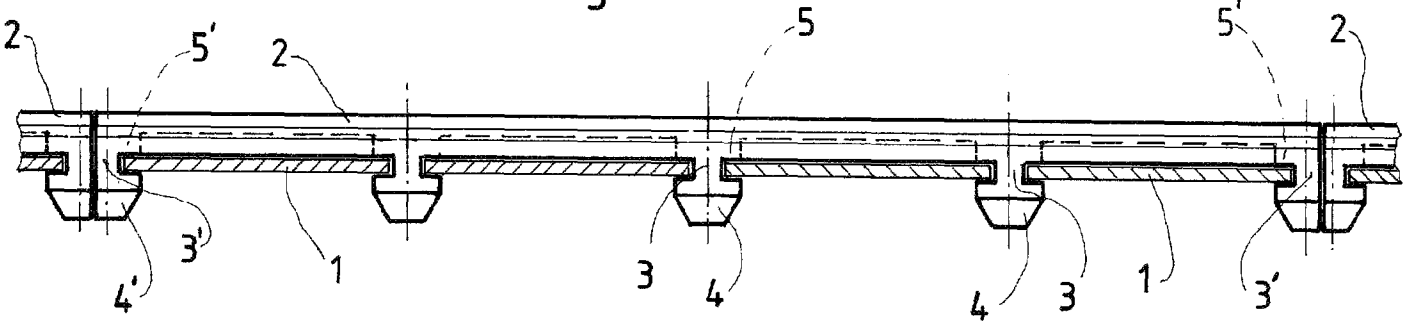
FIG. 2 is a top view of the traffic barrier in FIG. 1.

The traffic barrier of FIGS. 1 and 2 has screening and/or noise-protection elements 1 (hereafter called protective elements 1) held by deflectors 2. The deflectors 2 here are connected to braces 4 by connectors 3. These connectors 3 extend essentially from the ground up to the tops of the deflectors 2.

Figure 4:
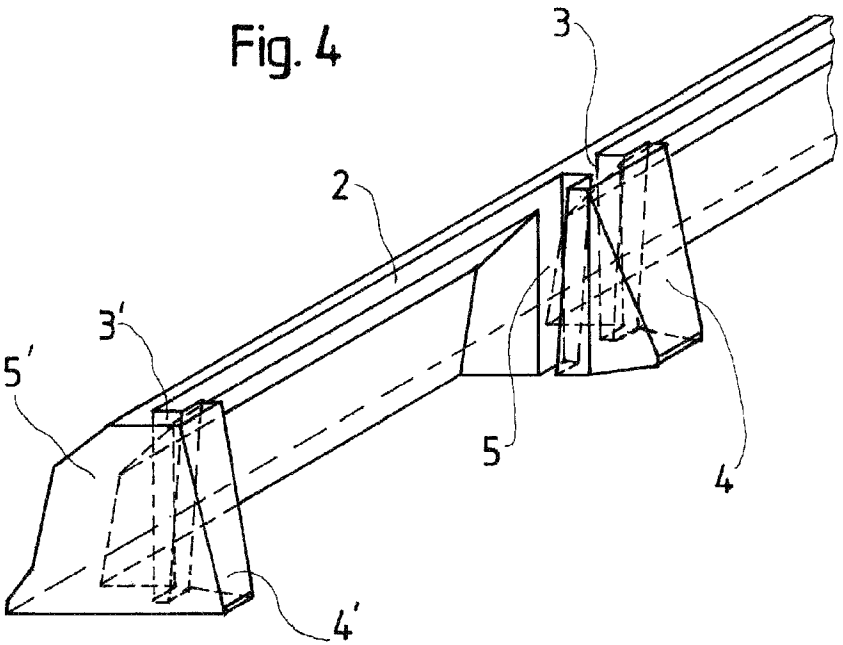
FIG. 4 is a perspective rear view of the barrier.

The connectors 3 are narrower than the braces 4 and extend away from reinforcement ribs 5 that themselves project from the backs of the deflectors 2 (FIG. 4).

The ends of each deflector 2 carry reinforcement ribs 5', connectors 3', and braces 4', each of which is preferably half the width of the other reinforcement ribs 5, connectors 3, or braces 4. These short reinforcement ribs 5' create flat end faces on the deflectors 2, thereby ensuring a good fit between adjacent deflectors 2 during construction of a traffic barrier.

The bottom edges of the protective elements 1 have open slots 6 whose width essentially corresponds to the width of the connectors 3 plus requisite installation tolerances. Varying the distance between the braces of the deflectors and the screening and/or noise-protection elements ensures a progressive absorption of energy due to the displacement of the system that occurs in the event of an impact. The connectors 3 engage in the slots 6 of the protective elements 1 when installed. The depth here of the slots 6 is somewhat less than the height of the deflectors 2, with the result that the protective elements rest on the connectors 3 and 3', and a small gap 7 remains between the lower edges of the protective elements 1 and the ground under the deflectors 2. This ensures that the entire weight of the protective elements 1 bears down on the deflectors 2 and that these elements have a correspondingly high level of resistance to toppling over in response to a wind load or an impact.

Figure 3:
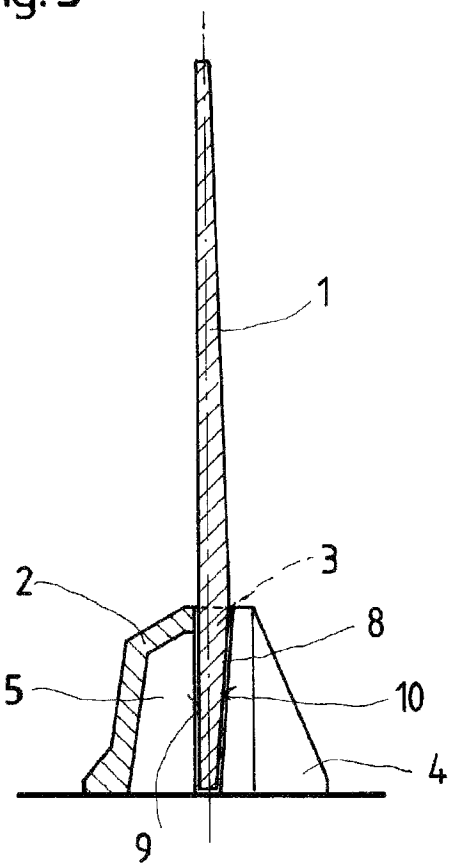
FIG. 3 is cross section through the traffic barrier of FIGS. 1 and 2.

FIG. 3 shows that the thickness of each protective element 1 tapers down toward its bottom edge in a lower region 8 engaged in the deflectors 2. Continuous flat faces 9 here confront the deflectors 2. The confronting faces of the reinforcement ribs 5 and 5' and of the braces 4 and 4' are complementary to the faces 9 and to the angled faces 10 of the regions 8 of the protective elements 1.

Recesses 6' are provided at the ends of the protective elements, these recesses preferably corresponding to half of the slots 6 (FIG. 1).

In principle, the reinforcement ribs 5', the connectors 3', and the braces 4' can also have the full width of the other reinforcement ribs 6, the connectors 3, and the braces 4 in the end regions of the deflectors 2; however, complementarily dimensioned recesses 6' must then be provided at the ends of the protective elements.

Figure 5:
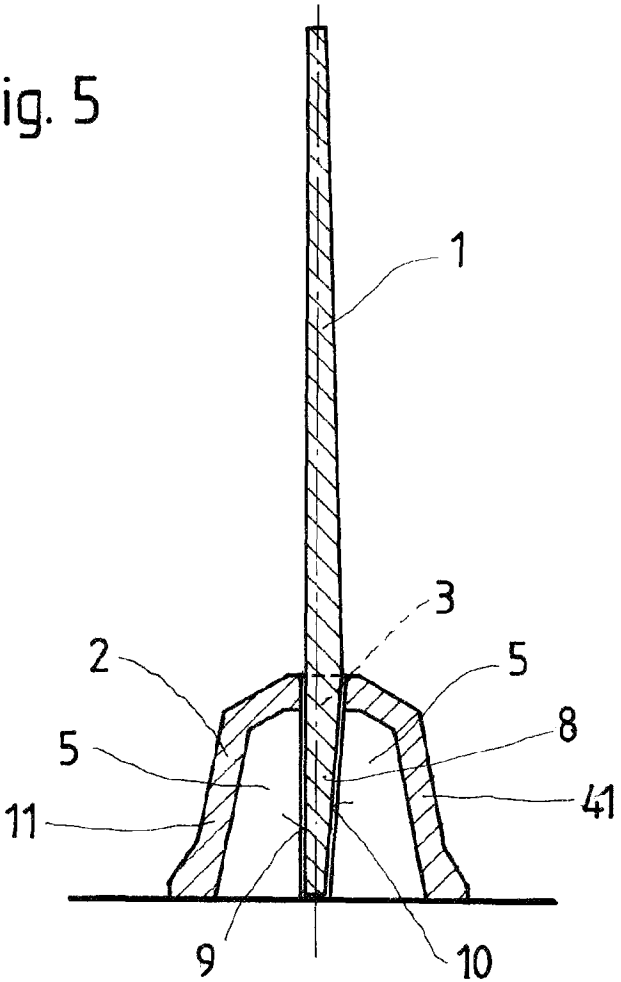
FIG. 5 is a schematic, sectional end view of another embodiment of a traffic barrier according to the invention.

In the embodiment of FIG. 5, the brace 4 has been replaced by a brace 41 that is implemented essentially mirror-symmetrical to the plane of the deflector 2. Here the connectors 3 on which the protective elements 1 rest are provided between the braces 41.

Figure 6:
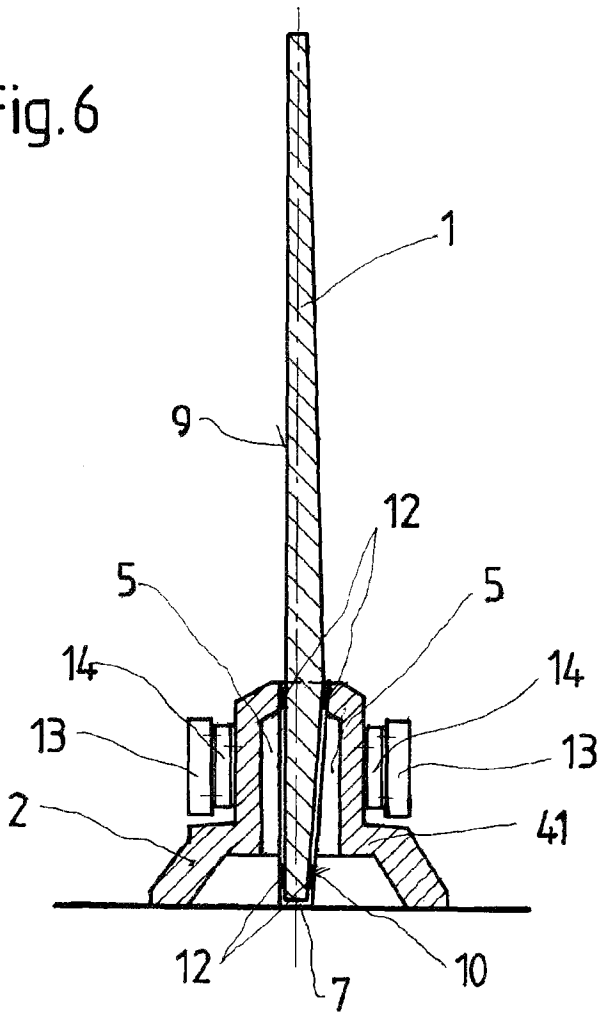
FIG. 6 is a sectional end view of another embodiment of a traffic barrier according to the invention including impact elements attached by spacers.

As is evident in FIG. 6, elastic shims 12 can be inserted between the faces 9 of the protective elements 1 and the confronting faces of the reinforcement ribs 5 of the deflectors 2, and the angled faces of the protective elements 1 and the confronting faces of the braces 41.

In addition, impact elements 13 provided on the sides of the deflectors 2 that face the roadway are attached to the deflectors 2 or the braces 41 by spacers 14.

Figure 7:
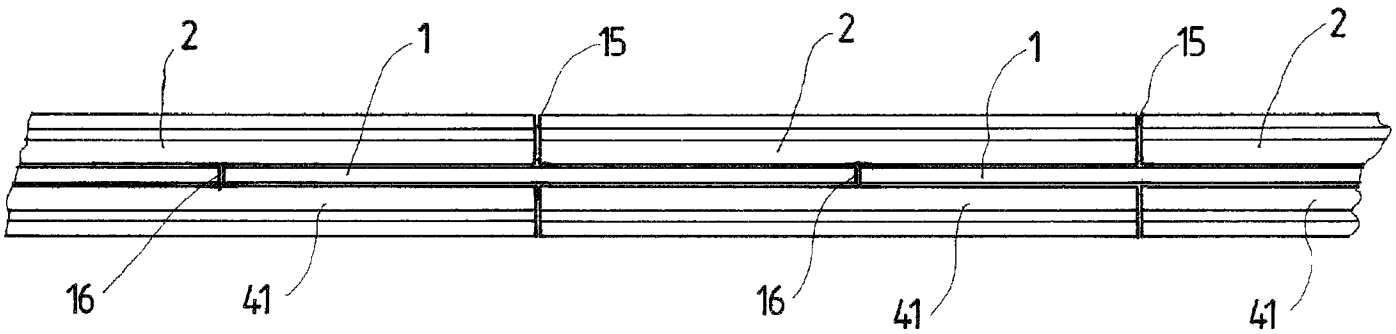
FIG. 7 is a top view of the traffic barrier of FIG. 5.

When a traffic barrier according to the invention is constructed, as is evident in FIG. 7, joints 15 between the deflectors 2 are offset relative to joints 16 between the protective elements 2 on the other side. The offset advantageously corresponds here to half the length of these elements 2 and 1. As a result it is not necessary to connect these elements 2 and 1 with ties.

Figure 8:
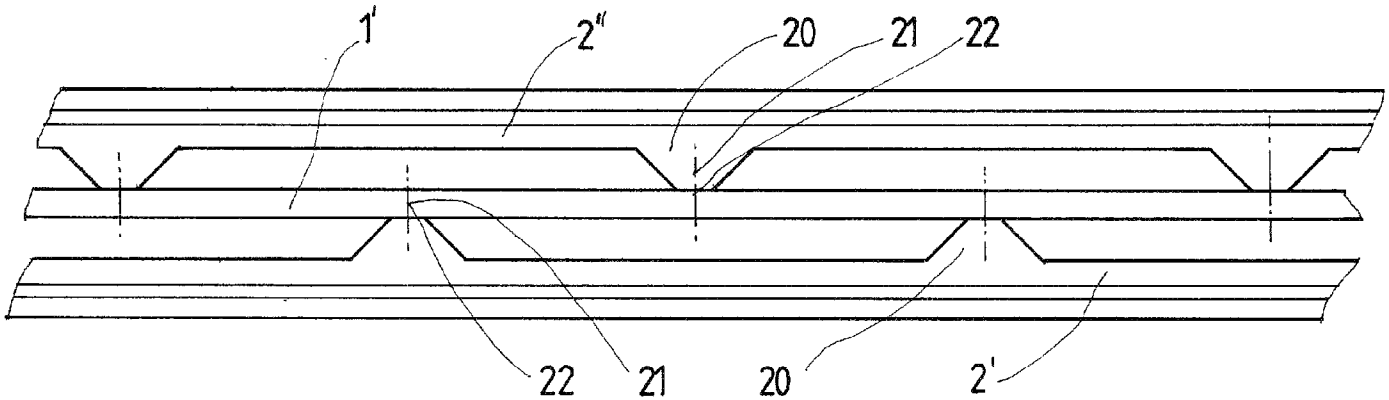
FIG. 8 is a top view of an alternative embodiment of the invention.
Figure 9:
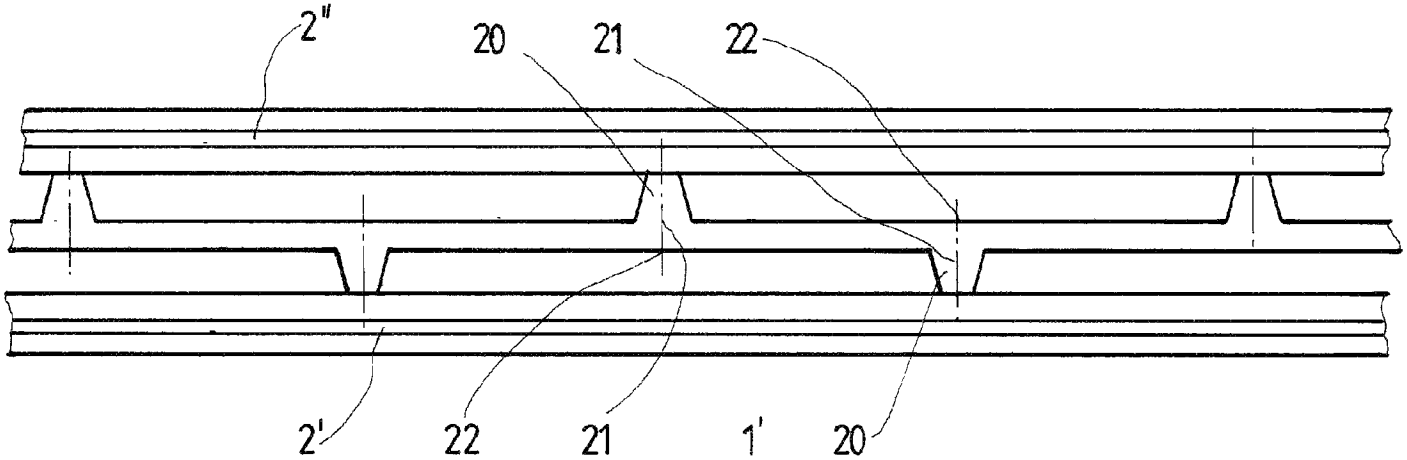
FIG. 9 is a top view of another alternative embodiment of the invention.

FIGS. 8 and 9 show respective alternative embodiments of the invention in which protective elements 1' are connected by fasteners 21 to deflectors 2' or to braces 2". These fasteners project here through holes 22 in the faces of the protective elements 1', the holes 22 being in the region of spacers 20. The spacers 20 can be integrally molded as one piece into the deflectors 2' (FIG. 8) or into the protective elements 1' (FIG. 9).

The invention claimed is:

1. A vehicular roadside traffic barrier system comprising:

a row of concrete deflectors adapted to sit on the ground;

a respective concrete connector projecting forward from and unitary with each of the deflectors and at a predetermined height above the ground;

a respective concrete brace fixed unitarily at a front end of each of the connectors spaced from the respective deflector; and a plurality of concrete panels between the braces and the panels, having front faces juxtaposed with and restrained from tipping by the braces and rear faces bearing on the deflectors, and each formed with at least one slot fitted over a respective one of the connectors, open downwardly at a bottom edge of the respective concrete panel, and having a top of such a depth relative to the height of the respective connector that the lower edge of the respective panel is spaced by a gap above the ground.

2. The traffic barrier system defined in claim 1, further comprising:

elastic shims between the front and back faces of the concrete panels and confronting faces of the deflectors and their braces.

3. The traffic barrier system defined in claim 1, wherein the concrete panels taper downward in a lower region engaging the deflectors, and confronting faces of the deflectors and the braces are complementary, one of the front and back faces face of each of the concrete panels being continuously flat.

4. The traffic barrier system defined in claim 1, wherein the braces are arrayed essentially mirror-symmetrical to the deflectors.

5. The traffic barrier system defined in claim 1, wherein multiple deflectors or braces, and multiple concrete panels are connected in succession, joints between the individual deflectors or braces on the one side, and joints between the individual concrete panels on the other side being offset relative to each other.

6. The traffic barrier system defined in claim 1, further comprising:

impact panels attached by spacers to a side of the deflectors facing a roadway.

7. A vehicular roadside traffic barrier system comprising:

a longitudinally extending row of longitudinally spaced upstanding concrete deflectors adapted to sit on the ground;

a respective concrete connector projecting forward from and unitary with each of the deflectors and at a predetermined height above the ground;

a respective concrete brace fixed unitarily at a front end of each of the connectors spaced from the respective deflector; and a plurality of concrete panels between the braces and the panels, having front faces juxtaposed with and restrained from tipping by the braces and rear faces bearing on the deflectors, and each formed with a plurality of longitudinally spaced slots fitted over a respective one of the connectors, open downwardly at a bottom edge of the respective concrete panel, and having a top of such a depth relative to the height of the respective connector that the lower edge of the respective panel is spaced by a gap above the ground.

8. The system defined in claim 7, wherein each of the panels is formed with at least three of the slots including at least one middle slot and longitudinally outwardly and downwardly open end slots at longitudinal ends of the panel, each of the deflectors having at least three of the connectors and of the braces including at least one middle connector and brace and a connector and a brace at each end, the connectors and braces at the ends being abutted in the row and engaged in the middle slots of the panels and the connectors.

* * * * *